US005081732A

United States Patent [19]

Steinhilber

[11] Patent Number: 5,081,732

[45] Date of Patent: Jan. 21, 1992

[54] ROTARY HEADING MACHINE

[76] Inventor: Wilhelm A. Steinhilber, 124 White Birch Dr., Guilford, Conn. 06437

[21] Appl. No.: 660,663

[22] Filed: Feb. 25, 1991

[51] Int. Cl.[5] ..... B21G 3/20

[52] U.S. Cl. ..... 10/52; 10/43

[58] Field of Search ..... 10/43, 52, 47, 39; 72/190, 191, 192, 195, 423, 133

[56] References Cited

U.S. PATENT DOCUMENTS

| | | | |
|---|---|---|---|
| 3,277,684 | 10/1966 | Gareri | 10/52 |
| 3,640,113 | 2/1972 | Heller et al. | 72/423 |
| 4,918,809 | 4/1990 | Steinhilber | 10/52 |

FOREIGN PATENT DOCUMENTS

| | | | |
|---|---|---|---|
| 8903734 | 5/1989 | PCT Int'l Appl. . | |
| 8903735 | 5/1989 | PCT Int'l Appl. . | |
| 0448146 | 10/1974 | U.S.S.R. | 72/191 |

*Primary Examiner*—Lowell A. Larson
*Assistant Examiner*—Michael J. McVera
*Attorney, Agent, or Firm*—McCormick, Paulding & Huber

[57] ABSTRACT

A nail forming machine having a rotary transport ring for receiving axially elongate cut wire nail blanks and transporting the nail blanks to and through a forming station with the axes of the nail blanks carried by the transport ring disposed in axially parallel alignment with the axis of rotation of the transport ring. A clamping ring is supported for rotation within the transport ring. Radially outwardly open clamping recesses formed in the peripheral surface of the clamping ring cooperate with associated radially inwardly open nail receiving recesses in the inner peripheral surface of the transport ring to clamp a nail blank therebetween as the nail blank is conveyed through a forming station by the transport ring. A circumaxial series of reciprocally moveable forming plungers are supported for rotation with the clamping ring. Each forming plunger is driven toward the projecting end of a nail blank clamped between the clamping ring and transporting ring as the nail blank moves through the forming station whereby a head is formed on the nail blank.

19 Claims, 6 Drawing Sheets

ROTARY HEADING MACHINE

BACKGROUND OF THE INVENTION

This invention relates in general to heading machinery and deals more specifically with an improved rotary machine for continuous operation to form a succession of headed workpieces or fasteners such as nails from preformed axially elongate workpieces such as cut wire nail blanks.

A typical machine of the type with which the present invention is concerned is illustrated and described in International Application Publications No. WO 89/03734 and WO 89/03735, both published May 5, 1989, and has a rotary holding ring assembly for receiving and holding a succession of workpieces or nail blanks in radially disposed position while continuously advancing the blanks along a circular path. A forming roller disposed within the ring assembly and in the path of advancing nail blanks engages and upsets radially inwardly projecting end portions of the advancing nail blanks to form heads thereon. The holding ring assembly includes a pair of opposing holding rings journalled for rotation in side-by-side relation about mutually inclined intersecting axes. The holding rings carry a plurality of sets of opposing dies for wedgingly clamping each nail blank therebetween as the blank, which is clamped to one of the rings, moves through a forming station where the upsetting or head forming operations are performed.

In a machine of the aforesaid type, a nail blank is injected in a radial direction from a stationary position toward and into holding clamps at each blank receiving station on the rotating ring assembly. At each blank receiving station there is only a small "window" opening, through which a blank can be injected as the station passes the injecting position. This arrangement requires extremely fast blank injection speed. In general, very accurate machine tuning is required to avoid malfunction. In actuality this difficulty in machine tuning is usually overcome by running the machine at a lower speed, thereby sacrificing production.

The machine illustrated in the aforesaid application publications has a holding ring assembly which includes thirty six nail receiving stations and carries thirty six separate sets of nail forming dies and thirty six separate holding clamps. The die sets must be changed and the clamps adjusted or changed each time the machine is set up to form a different size fastener, which results in considerable machine down time.

It is the general aim of the present invention to provide an improved machine of the aforedescribed generally type capable of continuous high speed operation at a relatively low noise level and having simplified tooling which may be rapidly adjusted to form headed workpieces such as nails or like fasteners in a range of sizes with minimal machine downtime.

SUMMARY OF THE INVENTION

In accordance with the present invention, a rotary heading machine is provided which has rotary transporting means for receiving at least one axially elongate workpiece and conveying the workpiece along an arcuate path to and through a forming station with the axis of the workpiece in generally parallel axial alignment with the axis of the arcuate path. The machine further includes rotary clamping means for cooperating with rotary transporting means to securely hold the workpiece as the workpiece is conveyed through the forming station and forming means for engaging an exposed end of the workpiece to form a head thereon as the workpiece is conveyed through the forming station by the rotary transporting means.

DETAILED DESCRIPTION OF PREFERRED EMBODIMENT

Figure 1:
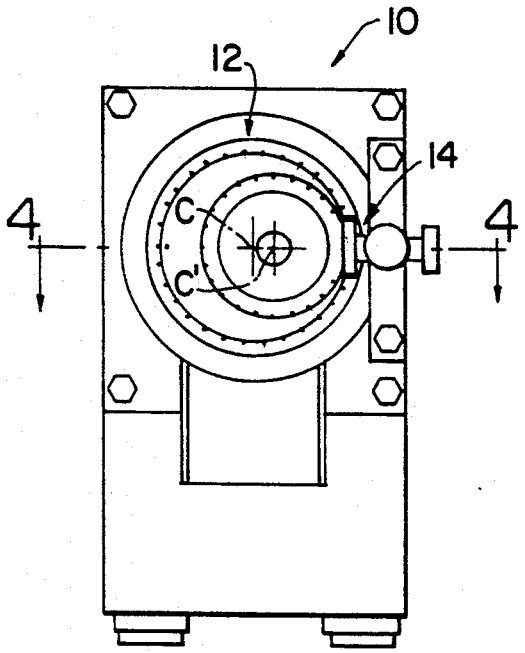
FIG. 1 is a front elevational view of a nail making machine embodying the present invention.
Figure 2:
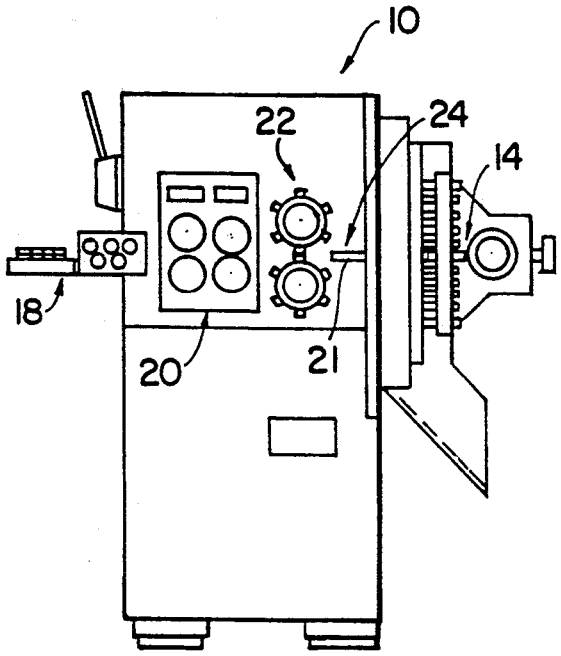
FIG. 2 is a side elevational view of the machine shown in FIG. 1.

Referring now the drawings the invention is illustrated and described with reference to a rotary nail making machine embodying the present invention and indicated generally by the reference numeral 10. The illustrated machine 10 is particularly adapted to form nails from precut axially elongate workpieces or wire nail blanks and includes a rotary transporting assembly, indicated generally at 12, for receiving successive nail blanks, indicated by the letters B, B, and conveying the blanks along an arcuate path having its center coincident with the center of rotation of the transporting assembly. The nail blanks B, B are held by the transporting assembly 12 with the axes thereof in generally parallel alignment with the axis of rotation of the transporting assembly, indicated by the letter C, and are conveyed by the transporting assembly to and through a forming station designated generally by the letter S in FIG. 9. A rotary clamping assembly, indicated generally at 14, cooperates with the rotary transporting assembly 12 at the forming station S to clamp and securely hold each nail blank B as it is conveyed through the forming station. A forming tool 16 engages the nail blank as it is conveyed through the forming station S and forms a head on an exposed projecting end portion of the nail blank B. The headed or completed nail, indicated by the letter N, is further conveyed from the forming station S to an ejecting station E where it is released from the transporting assembly 12, all of which will be hereinafter more fully described.

Figure 3:
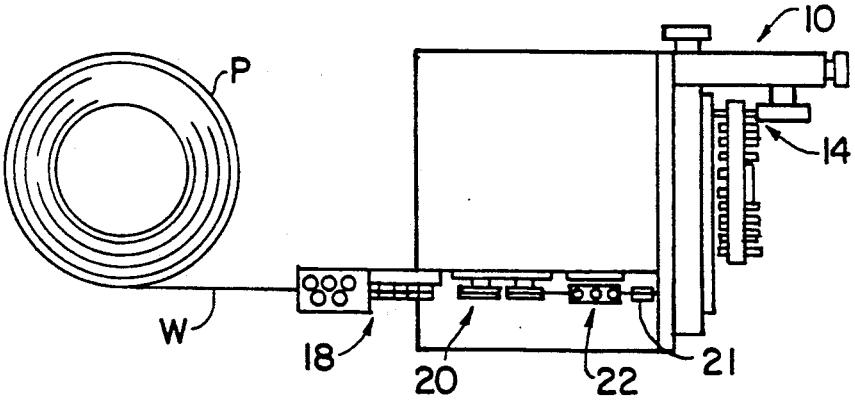
FIG. 3 is a plan view of the machine.

Considering now the machine 10 in further detail, the machine is adapted to receive wire W of indefinite length payed from a package, such as the coil P shown in FIG. 3, and includes a wire straightening mechanism indicated generally at 18, variable speed feed rollers, indicated generally at 20 for advancing the wire W, a cutting apparatus, designated generally by the numeral 22, for severing nail blanks B, B from the wire W as the wire is advanced by the feed roller system 20 and an injecting or inserting device, indicated generally at 24, for feeding nail blanks B, B severed from the wire W to the transporting assembly 12.

Figure 11:
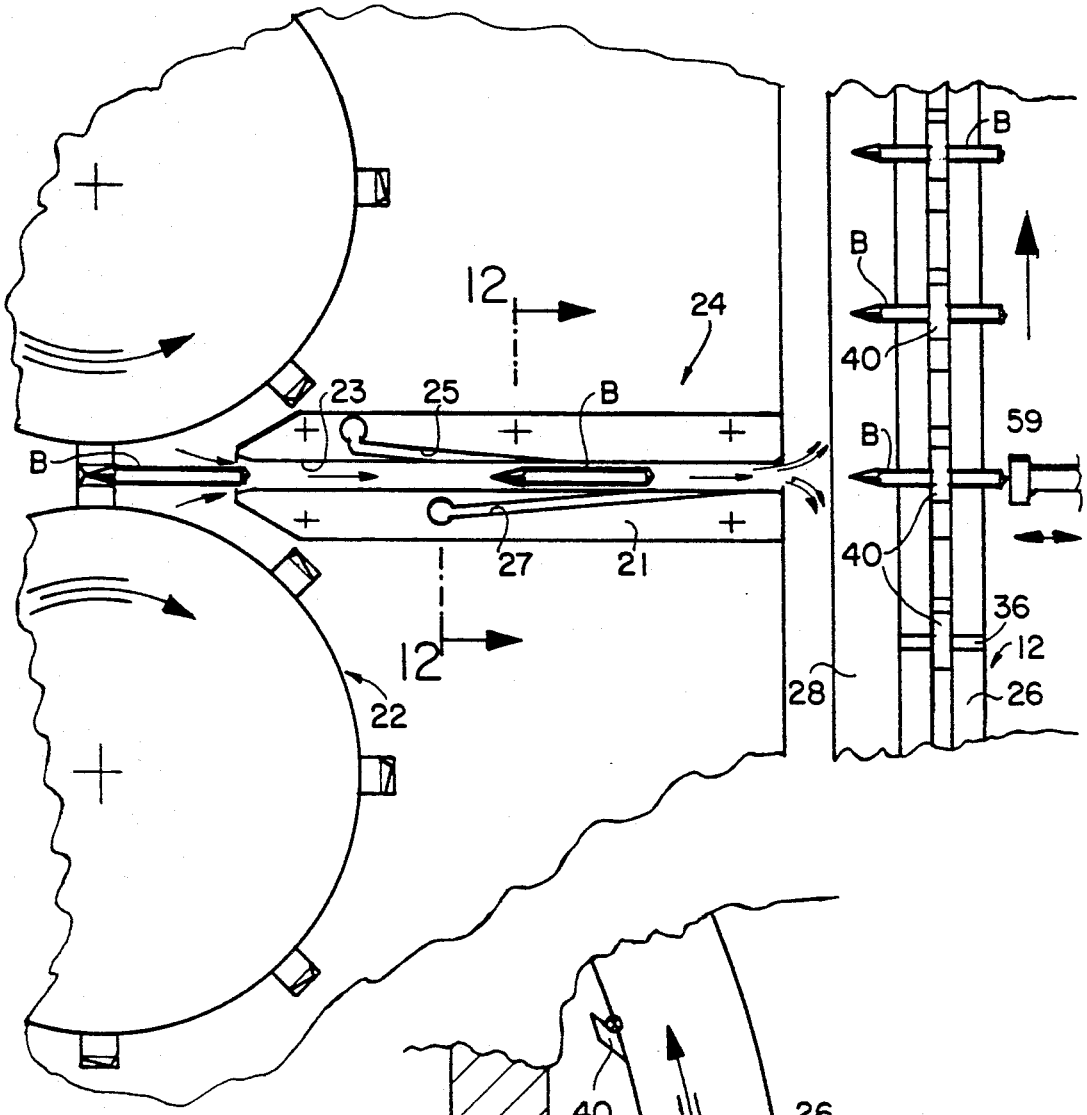
FIG. 11 is a somewhat enlarged front elevational view of the venturi injection tube.
Figure 12:
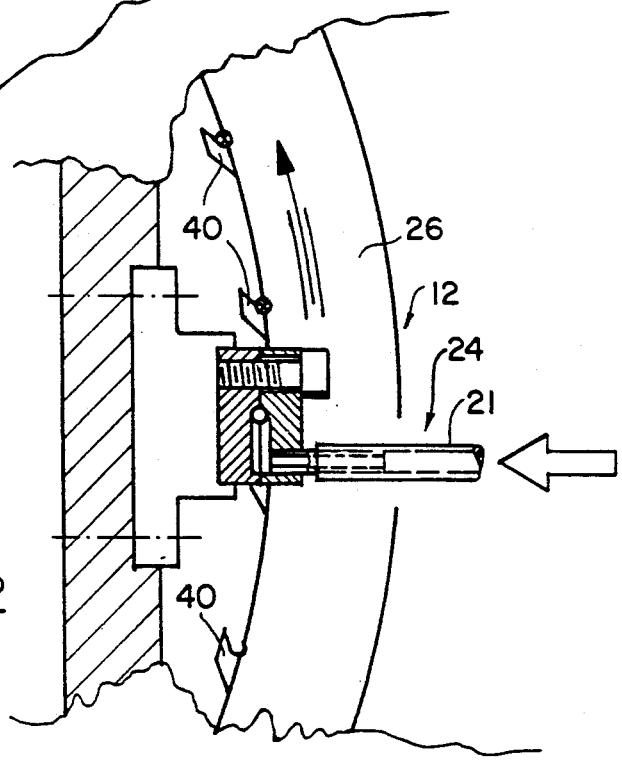
FIG. 12 is a sectional view, taken along the line 12—12 of FIG. 11.

The inserting device 24 includes a venturi tube 21, best shown in FIGS. 11 and 12, which has a bore 23 coaxially aligned with the path of the wire W advanced by the feed roller system 20. A pair of air passageways 25 and 27 connected to a source of air under pressure (not shown) communicate with the bore 23, substantially as shown in FIG. 11, to produce vacuum at the downstream end of the bore. The inserting device 24 further includes a stationary nail blank support member 29 and a generally L-shaped spring biased restraining member 31, shown in FIG. 7, which cooperate to define a nail blank pickup station 33, as will be hereinafter further discussed.

Figure 4:
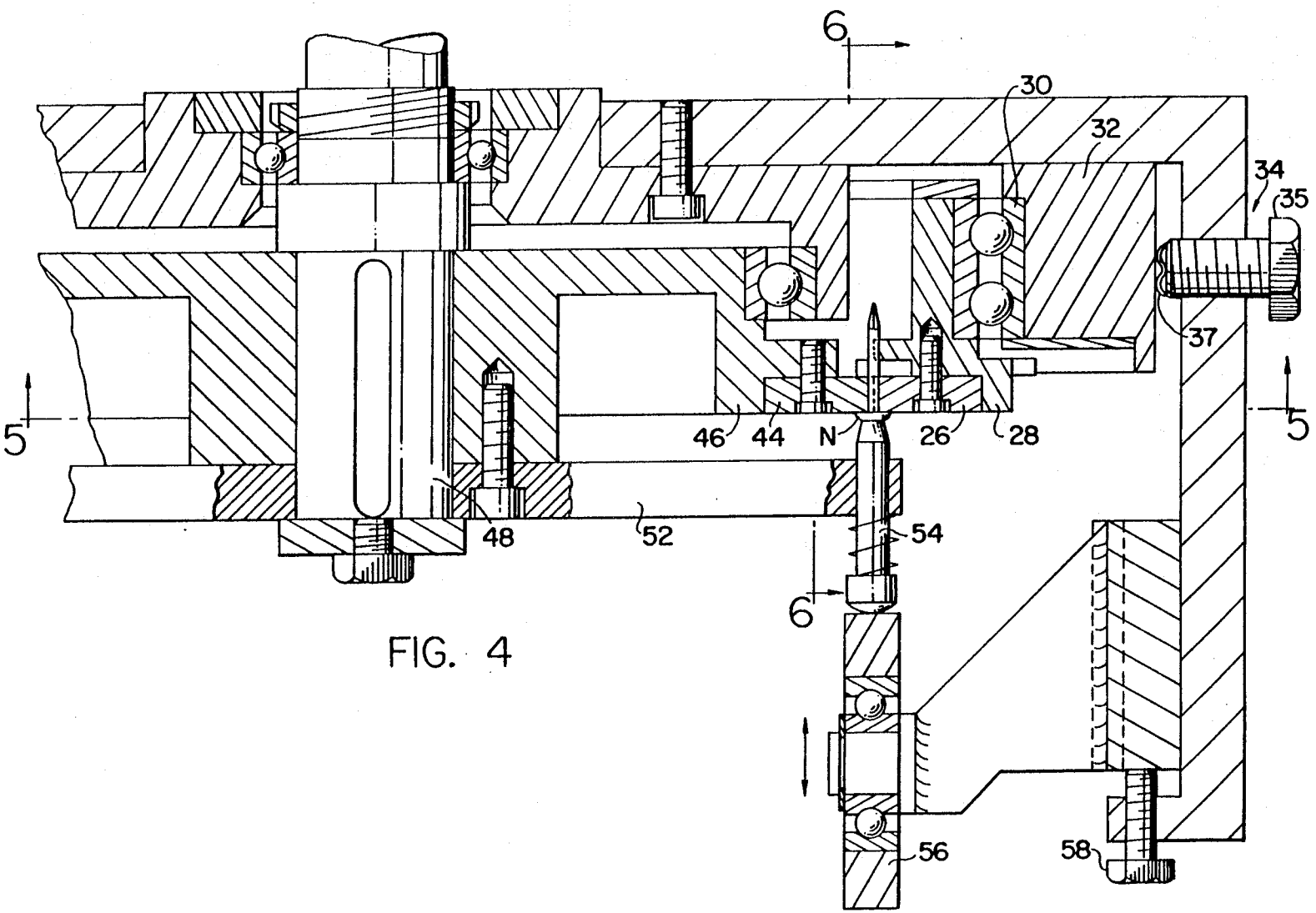
FIG. 4 is a somewhat enlarged fragmentary sectional view taken along the line 4—4 of FIG. 1.
Figure 5:
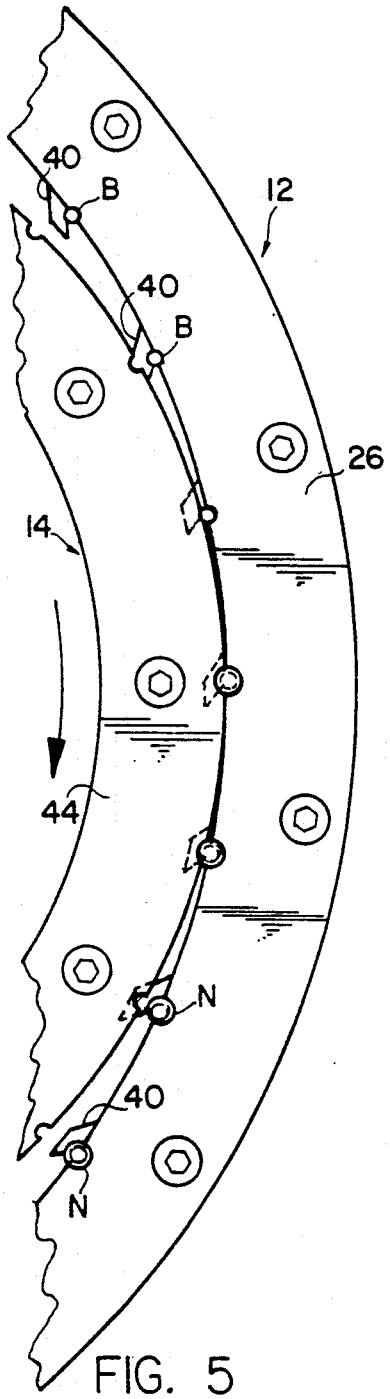
FIG. 5 is a fragmentary sectional view taken generally along the line 5—5 of FIG. 4.

The transporting assembly 12 includes a circular transport ring 26 fastened to a rotary carrier 28. The carrier 28 is supported for rotation relative to the machine frame within an annular bearing 30 supported within an annular bearing carrier 32 as shown in FIG. 4. The bearing carrier 32 is mounted on the machine frame for limited movement in a horizontal direction relative to the machine frame by studs received within horizontal slots in the frame. A pressure plunger assembly, indicated generally at 34 and which includes a fastener 35, threadably engaged with the machine frame, and a spring washer 37, which acts between an end of the fastener 35 and the bearing carrier 32, biases the transport ring 25 in a horizontal direction and toward engagement with the clamping assembly 14. However, other biasing means may be employed and in a larger machine, for example, the biasing force may be supplied by a suitable hydraulic accumulator.

The inner peripheral surface of the transporting ring 26 is partially defined by a circumaxial series of equangularly spaced and radially inwardly open nail blank receiving recesses 36, 36. Each recess 36 is adapted to receive and complement an associated portion of a nail blank B whereby to support the nail blank with its axis parallel to the axis of rotation C.

Figure 7:
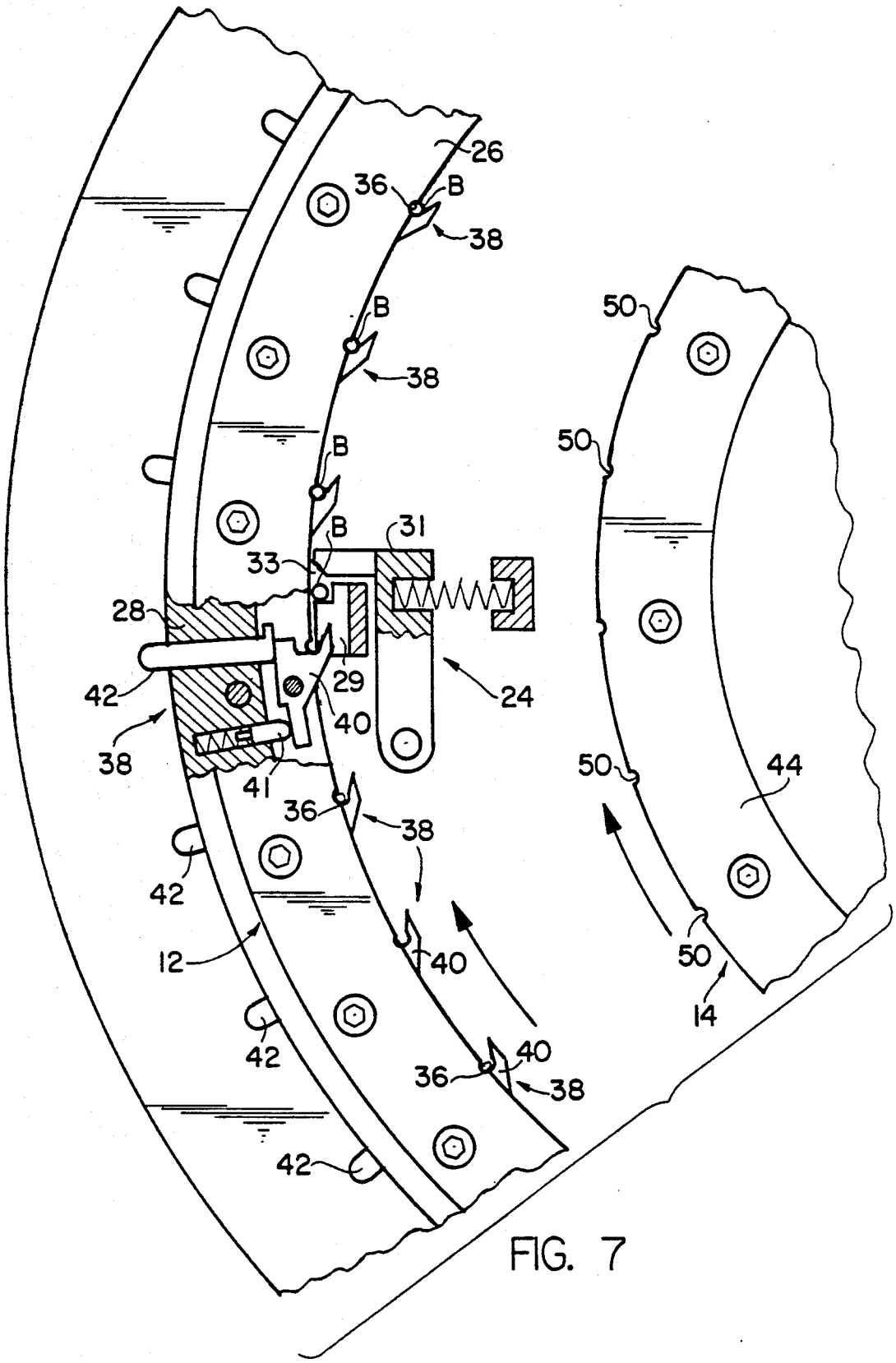
FIG. 7 is a somewhat enlarged fragmentary front elevational view of the machine shown partially in vertical section.

Referring now particularly to FIG. 7, the transporting assembly 12 includes a plurality of nail blank holder assemblies 38, 38 equal in number to said nail blank receiving recesses 36, 36 for holding nail blanks within the latter recesses while the nail blanks are conveyed by the transporting assembly 12. A typical nail blank holder assembly 38 associated with a nail blank recess 36 is shown in FIG. 7 and includes a generally hook shaped holder 40 pivotally supported on the transport assembly 12 within an annular recess between the transport ring 26 and the rotary carrier 28. The illustrated holder 40 is biased to a nail blank holding position by a spring plunger 41. A releasing rod 42 is associated with each holder 40 for moving the holder to a releasing position, as will be hereinafter further discussed.

The clamping assembly 14 comprises a circular clamping ring 44 fastened to a rotary carrier 46 supported on and keyed to a drive shaft 48, as best shown in FIG. 4. The shaft 48 is driven by a motor and an associated gear train (not shown). The clamping ring 44 has an outer peripheral surface which is partially defined by a circumaxial series of radially outwardly open nail blank clamping recesses 50, 50. The number of nail blank receiving recesses 36, 36 in the transporting assembly 12 is greater than the number of nail blank clamping recesses 50, 50 in the clamping assembly. However, it should be noted that the circular pitch of the recesses 36, 36 is substantially equal to the circular pitch of the recesses 50, 50.

Figure 9:
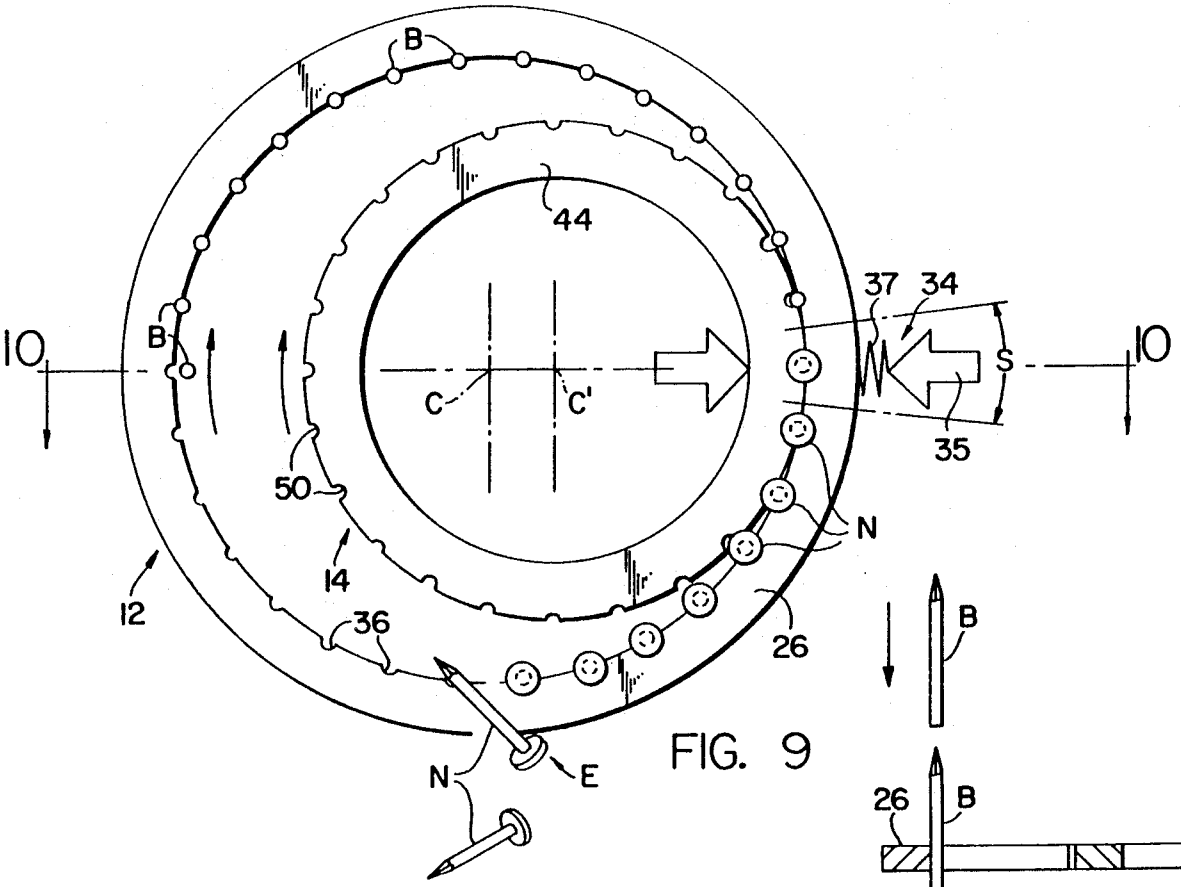
FIG. 9 is a somewhat schematic front elevational view of the machine.

The rotary transporting and clamping assemblies are supported on the machine frame in eccentric axially parallel relation to each other, the center of rotation of the clamping assembly being indicated at C', so that the outer peripheral surface of the clamping assembly 14 is in engagement or near engagement with the inner peripheral surface of the transporting assembly 12 at the three o'clock position, as best shown in FIGS. 1 and 9.

The forming mechanism for cold forming heads on the extending end portions of the nail blanks as the blanks are conveyed through the forming station S includes a circular disk 52 fastened in fixed position to the rotary carrier 46 for coaxial rotation with it. The disk 52 carries a circumaxially series of equangularly spaced forming plungers 54, 54 equal in number to the clamping recesses 50, 50 defined by the circular clamping ring 44. Each plunger 54 is supported for reciprocal movement in an axial direction relative to the disk 52 and is coaxially aligned with the axis of an associated parti-cylindrical clamping recess 50. The forming mechanism further includes a forming roller 56 journalled for rotation about a fixed axis relative to the machine frame at the forming station S and in the path of arcuate travel of the forming plungers 54, 54 which rotate with the disk 52, as shown in FIGS. 1 and 4. The forming roller 56 is further arranged for adjustment generally toward and away from the forming plungers at the forming station S by an adjustment screw 58, shown in FIG. 4.

Nail wire W, payed from the coil P is drawn into the machine 10 through the wire straightening mechanism 18 by the feed roller system 20. The wire cutting apparatus 22, which operates in timed relation to the feed mechanism 20, severs a nail blank B from the leading end of the wire W and simultaneously points the trailing end of the blank. The severing operation occurs as the leading end of the wire W enters the venturi tube 21 associated with the inserting or injecting mechanism 24. When the nail blank B is severed from the wire it is drawn by vacuum through the venturi tube. The nail blank B is accelerated or projected to a pickup position wherein the forward end of the nail blank is disposed forward of the front face of the transport ring 26 at which position the nail blank is arrested by an adjustable stop 59. The portion of the nail blank B which extends beyond the face of the transport ring 26 will subsequently become the head of a completed nail. The length of nails to be produced by the machine 10 is determined by the feed speed of the incoming wire. If a longer nail blank is desired the feed speed of the incoming wire is increased by adjusting the operating speed of the variable speed feed rolls 20. Shorter nail blanks are produced by decreasing the feed speed of the wire.

The cutting apparatus 22 is driven in timed relation with the conveying speed of the transport assembly so that each nail blank arrives at the pickup position within the inserting device 24 and comes to rest on the nail blank support member 29 in the path of an advancing nail blank holder 40. As the latter nail blank holder 40 passes the inserting station 24 the nail blank restraining member 31 cooperates with the hook shaped holder 40 to restrain the nail blank until the holder engages the blank and secures it within an associated nail receiving recess 36 at which time the secured nail blank cams the spring biased restraining member 31 out of its path.

Nail blanks are loaded into the machine 10 at the nine o'clock position and are conveyed in clockwise direction by the transport assembly 12 to and through the forming station at the three o'clock position. As a nail blank disposed within an associated recess 36 approaches the forming station S the gap between the inner peripheral surface of the transporting assembly 12 and the outer peripheral of the clamping assembly 14, which is also rotating in the same direction, closes. Since the circular pitch of the blank receiving recesses 36 is substantially equal to the circular pitch of the clamping recesses 50 a clamping recess will come into registry with an associated nail blank as the nail blank approaches the forming station. Thus, each clamping recess 50 cooperates with an associated nail receiving recess 36 in the region of the forming station S to securely clamp a nail blank therebetween with the forward end portion of the nail blank protruding for some distance beyond the front faces of the transport ring 26 and the clamping ring 44.

Figure 6:
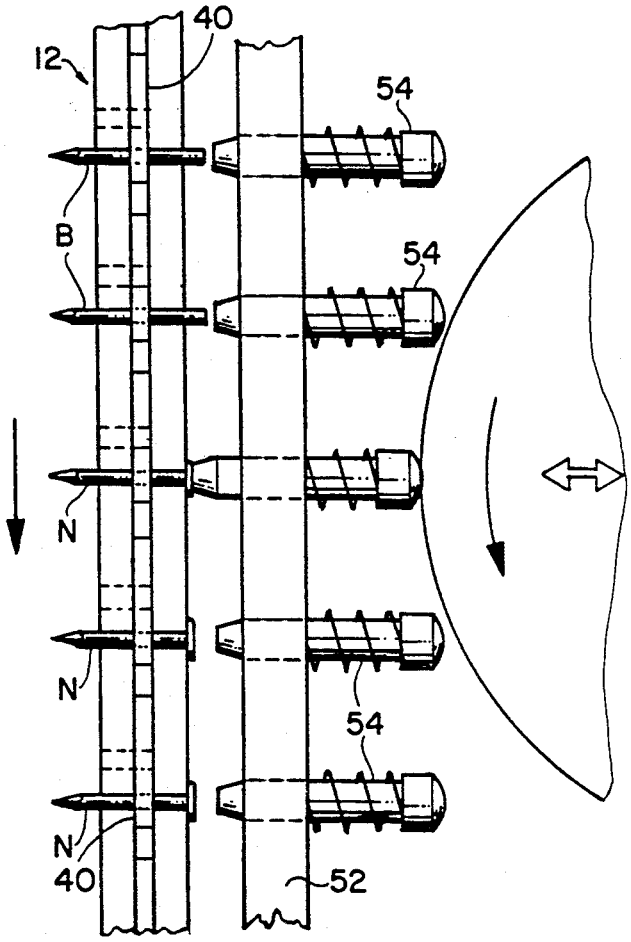
FIG. 6 is a fragmentary sectional view taken generally along the line 6—6 of FIG. 4.

As previously noted, the disk 52 is arranged for rotation in unison with the clamping ring 44. Thus, as each nail blank carried by the transporting assembly 12 approaches the forming station S an associated forming plunger 54 moves into engagement with the peripheral surface of the forming roller 56 and is urged in the direction of the transport ring 26 and the clamping ring 44, as shown in FIG. 6. Thus, the head forming operation occurs while the nail blank is tightly gripped between the transporting and clamping assemblies 12 and 14.

As a completed nail N is moved away from the forming station S by the transport assembly 12 the gap between the inner peripheral surface of the transport assembly and the outer peripheral surface of the clamping assembly increases, as best shown in FIG. 9. As the completed nail N approaches the six o'clock position the releasing rod 42 on the holding device 38 securing the nail to the transporting assembly engages a fixed cam surface (not shown) which opens the holding device 38. The protruding rear end portion of the nail which is traveling in an arcuate path substantially simultaneously engages a cantilever spring member which flips the completed nail forwardly in the direction of a discharge chute at the front of the machine which guides the completed nail into a barrel or other reciprocal.

The clamping assembly 14 and the transport assembly 12 may be positively driven in timed relation to each other by suitable gearing. However, in accordance with the presently preferred embodiment of the invention only the clamping assembly 14 is positively driven by the machine drive motor. The transport ring 26 is driven by the clamping ring 44 by means of the nail blanks carried by the transport ring 26 in the vicinity of the forming station S. The nail blanks carried by the transport ring 44 function as cogs or gear teeth and engage the clamping recesses 50, 50 of the driven clamping ring 44 which, in turn, impart rotary motion to the transport ring 26.

Figure 8:
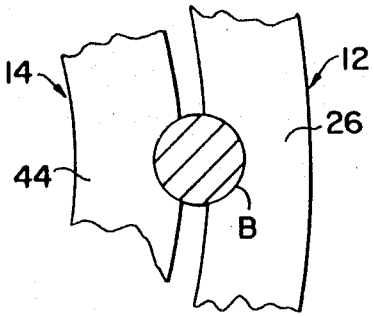
FIG. 8 is a somewhat further enlarged front elevational view of the transport ring and clamping ring shown with a nail blank clamped therebetween.
Figure 10:
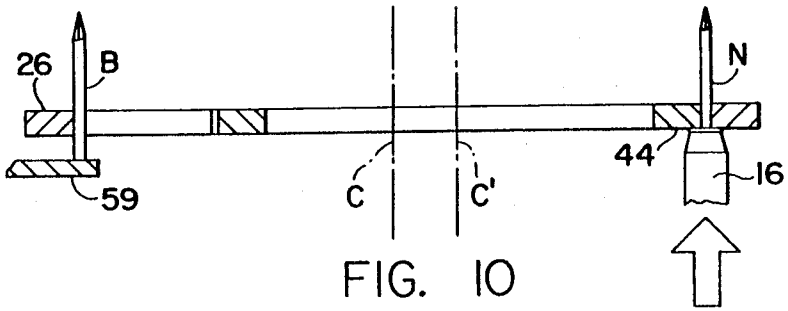
FIG. 10 is a sectional view taken along the line 10—10 of FIG. 9.

The depth of the nail blank receiving recesses 36, 36 and the clamping recesses 50, 50 is calculated to provide a relatively minute gap between the inner peripheral surface of the transporting assembly 12 and the outer peripheral surface of the clamping assembly 14 in the region of the forming station S when a nail blank is clamped therebetween, as best shown in FIG. 8 where the gap is indicated by the letter G. The plunger member 34 may be adjusted to increase or decrease the gripping force applied to the nail blank by the cooperating clamping and transport rings 44 and 26 by adjusting the pressure plunger assembly 34.

The size of the gap G is very small. Hence, if an empty space between a clamping recess 50 and an associated nail receiving recess 36 appears at the forming station S the pressure plunger assembly 34 will bias the inner peripheral surface of the transport ring 26 into frictional engagement with the outer peripheral surface of the clamping ring 44 at this point to establish frictional driving relationship therebetween, so that it is generally unnecessary to stop the machine 10 due to a loading malfunction. This arrangement also facilitates initial machine start making it unnecessary to "hand load" the machine.

The size and general configuration of nail or fastener heads produced by the machine 10 may be altered by utilizing the adjusting screw 58 to vary the position of the forming roller 56 relative to the forming plungers 54, 54.

I claim:

1. Rotary workpiece heading machine comprising rotary transporting means for receiving at least one axially elongate workpiece and conveying the one workpiece along an arcuate path to and through a forming station with the axis of the one workpiece in generally parallel axial alignment with the axis of said arcuate path and including an annular ring having an inner peripheral surface and supported for rotation about the axis of said arcuate path, rotary clamping means for cooperating with said rotary transporting means at said forming station to securely hold the one workpiece as the one workpiece is conveyed through said forming station and including a rotary clamping member supported for rotation within said annular ring and about an axis parallel to said axis of said arcuate path and defining another peripheral surface cooperating with said inner peripheral surface to securely hold the one workpiece therebetween as the one workpiece is conveyed through said forming station, and forming means at said forming station for engaging an associated end portion of the one workpiece and forming a head on the one workpiece as the one workpiece is conveyed through said forming station by said rotary transporting means.

2. Rotary workpiece heading machine as set forth in claim 1 wherein said inner peripheral surface is partially defined by a circumaxially series of workpiece receiving recesses and said other peripheral surface is partially defined by a plurality of workpiece clamping recesses.

3. Rotary workpiece heading machine as set forth in claim 2 wherein the number of said workpiece receiving recesses is greater than the number of said workpiece clamping recesses and the circular pitch of said workpiece receiving recesses is equal to the circular pitch of said workpiece clamping recesses.

4. Rotary workpiece heading machine as set forth in claim 1 wherein said forming means comprises at least one reciprocal moveable forming tool supported for rotation with said rotary clamping means and operating means for moving said forming tool as said one workpiece is conveyed through said forming station by said rotary transporting means.

5. Rotary workpiece heading machine as set forth in claim 4 wherein said forming tool comprises a plunger and said operating means comprises a rotary member disposed in the path of said plunger for moving said plunger toward said rotary transporting means.

6. Rotary workpiece heading machine as set forth in claim 1 including holding means for releasably securing the one workpiece to said transporting means.

7. Rotary workpiece heading machine as set forth in claim 6 including an ejecting station in the path of said holding means and releasing means for operating said holding means to release the one workpiece from said transporting means in response to movement of said holding means through said ejecting station.

8. Machine for forming an end portion of an axially elongate workpiece comprising rotary transporting means for conveying a workpiece such as aforesaid along a portion of a circular path to and through a workstation in a workpiece forming position wherein the axis of the workpiece is oriented in parallel relation to the path axis and a free end portion of the workpiece extends outwardly beyond said transporting means and including a first circular member supported for rotation about a first axis coincident with the axis of said path, rotary clamping means supported for rotation about another axis parallel to said path axis for cooperating with said transporting means to clamp the workpiece in fixed position relative to the transporting means as the workpiece is conveyed through said workstation and including a second circular member supported for rotation about a second axis generally parallel to said first axis, one of the members comprising said first and second members being an annular member and the other of said members being supported for rotation within said one member, and means for forming the extending free end portion of the workpiece as the workpiece is conveyed through said workstation.

9. Machine as set forth in claim 8 including holding means supported on said transporting means to rotate therewith for engaging and releasably securing a workpiece to said transporting means and inserting means for receiving a workpiece and projecting it to and retaining it in a workpiece forming position at a pickup station in the path of said holding means until the workpiece is engaged and releasably secured to said transporting means by said holding means.

10. Machine as set forth in claim 9 wherein said inserting means includes a workpiece support member partially defining said pickup station and a venturi means for receiving a workpiece and projecting it into said pickup station.

11. Machine as set forth in claim 10 including adjustable stop means for arresting a workpiece projected into said pickup station by said venturi means.

12. Rotary nail making machine comprising rotary transporting means for receiving an axially elongate nail blank and conveying the nail blank to and through a forming station and including a transport ring supported to rotate about a first axis of rotation and holding means for releasably retaining a nail blank received by said transport ring in a head forming position on the inner peripheral surface of said transport ring wherein the nail blank is disposed in axially parallel relation to said first axis of rotation with a free end portion thereof extending beyond said transport ring, rotary clamping means for cooperating with said transporting means to secure a nail blank in its head forming position as it is conveyed to and through the forming station and including a rotary clamping member supported within said transport ring to rotate about a second axis of rotation parallel to and spaced from said first axis of rotation and including an outer peripheral surface for cooperating with said inner peripheral surface to clamp the nail blank therebetween, and forming means for upsetting the extending free end portion of a nail blank to form a head thereon as the nail blank is conveyed through said forming station is a head forming position and including a forming plunger supported for rotation with and reciprocal movement relative to said clamping member and plunger operating means at said forming station for moving said plunger toward said transport ring to upset the free end portion in response to movement of the nail blank through the forming station.

13. Rotary nail former comprising an annular outer clamping member supported for rotation about an axis and having a coaxial inner peripheral surface defining a plurality of equangularly spaced and radially inwardly facing first clamping surfaces, an inner clamping member supported for rotation about an axis parallel to the axis of said outer clamping member and having a coaxial outer peripheral surface defining a plurality of equangularly spaced radially outwardly facing second clamping surfaces, the circumferential spacing between said first clamping surfaces being equal to the circumferential spacing between said second clamping surfaces, said inner clamping member being supported with its outer peripheral surface in substantial tangential engagement with said inner peripheral surface of said outer clamping member, drive means for rotating one of the clamping members about its axis, clamping means associated with one of said clamping members for releasably securing an associated axially elongated nail blank in engagement with each of the clamping surfaces on said one clamping member with the axis of the nail blank disposed in parallel relation to the axis of said one clamping member, loading means for feeding nail blanks in an axial direction to said one clamping member to load the clamping surfaces thereof, said one clamping member and said other clamping member defining a workstation at the point of closest relationship between said inner clamping member and said outer clamping member, and means for forming a head on each successive nail blank as said blank passes through said workstation.

14. Rotary workpiece heading machine comprising rotary transporting means for receiving at least one axially elongate workpiece and conveying the one workpiece along an arcuate path to and through a forming station with the axis of the one workpiece in generally parallel axial alignment with the axis of said arcuate path, rotary clamping means for cooperating with said rotary transporting means at said forming station to securely hold the one workpiece as the one workpiece is conveyed through said forming station, and forming means at said forming station for engaging an associated end portion of the one workpiece and forming a head on the one workpiece as the one workpiece is conveyed through said forming station by said rotary transporting means and including at least one reciprocal moveable forming tool supported for rotation with said rotary clamping means and operating means for moving said forming as said one nail blank is conveyed through said forming station by said rotary transporting means.

15. Rotary workpiece heading machine as set forth in claim 14 wherein said transporting means includes a rotary transport member supported for rotation about said axis of said arcuate path and defining a first peripheral surface and said clamping means includes a rotary clamping member supported for rotation about an axis parallel to said axis of said arcuate path and defining a second peripheral surface cooperating with said first peripheral surface to securely hold the one workpiece therebetween as the one workpiece is conveyed through said forming station.

16. Rotary workpiece heading machine as set forth in claim 15 wherein said transport member comprises an annular ring having an inner peripheral surface defining said first peripheral surface and said rotary clamping member is supported for rotation within said annular ring.

17. Rotary workpiece heading machine as set forth in claim 14 wherein said forming tool comprises a plunger and said operating means comprises a rotary member disposed in the path of said plunger for moving said plunger toward said rotary transporting means.

18. Rotary workpiece heading machine comprising rotary transporting means for receving at least one axially elongate workpiece and conveying the one workpiece along an arcuate path to and through a forming station with the axis of the one workpiece in generally parallel axial alignment with the axis of said arcuate path, holding means for releasably securing the one workpiece to said transporting means, rotary clamping means for cooperating with said rotary transporting means at said forming station to securely hold the one workpiece as the one workpiece is conveyed through said forming station, forming means at said forming station for engaging an associated end portion of the one workpiece and forming a head on the one workpiece as the one workpiece is conveyed through said forming station by said rotary transporting means, an ejecting station in the path of said holding means, and releasing means for operating said holding means to release the one workpiece from said transporting means in response to movement of said holding means through said ejecting station.

19. Machine for forming an end portion of an axially elongate workpiece comprising rotary transporting means for receiving a workpiece such as aforesaid at a pickup station and conveying the workpiece along a portion of a circular path to and through a workstation in a workpiece forming position wherein the axis of the workpiece oriented in parallel relation to the path axis and a free end portion of the workpiece extends outwardly beyond said transporting means, holding means supported on said transporting means to rotate therewith for engaging and releasably securing a workpiece to said transporting means, inserting means for receiving a workpiece and projecting it to and retaining it in a workpiece forming position at said pickup station in the path of said holding means until the workpiece is engaged and releasably secured to said transporting means by said holding means, rotary clamping means supported for rotation about another axis parallel to said path axis for cooperating with said transporting means to clamp the workpiece in fixed position relative to the transporting means as the workpiece is conveyed through said workstation, and means for forming the extending free end portion of the workpiece as the workpiece is conveyed through said workstation.

* * * * *